US008537641B2

(12) United States Patent
De Biase

(10) Patent No.: US 8,537,641 B2
(45) Date of Patent: Sep. 17, 2013

(54) TIMEPIECE HAVING A TIME INDICATOR HAND WHICH IS MOVABLE BETWEEN TWO POSITIONS

(75) Inventor: Alfredo De Biase, Le Sentier (CH)

(73) Assignee: Bulgari Horlogerie SA., Neuchatel (CH)

( * ) Notice: Subject to any disclaimer, the term of this patent is extended or adjusted under 35 U.S.C. 154(b) by 150 days.

(21) Appl. No.: 13/155,973

(22) Filed: Jun. 8, 2011

(65) Prior Publication Data

US 2011/0299365 A1 Dec. 8, 2011

(30) Foreign Application Priority Data

Jun. 8, 2010 (CH) ..... 0912/10

(51) Int. Cl.
*G04B 19/00* (2006.01)

(52) U.S. Cl.
USPC ..... 368/70; 368/224

(58) Field of Classification Search
USPC ..... 368/69–70, 224–225
See application file for complete search history.

(56) References Cited

U.S. PATENT DOCUMENTS

| | | | | | |
|---|---|---|---|---|---|
| 1,989,584 | A | * | 1/1935 | Biedenfeld | 368/228 |
| 2,353,280 | A | * | 7/1944 | Swisher | 368/220 |
| 2,462,839 | A | * | 3/1949 | Brown | 368/291 |
| 2,910,825 | A | * | 11/1959 | Kirkwood | 368/21 |
| 3,545,199 | A | * | 12/1970 | Rice, Jr. | 368/14 |
| 5,204,846 | A | * | 4/1993 | Brahaney | 368/228 |
| 2008/0020520 | A1 | | 1/2008 | Jan et al. | |

FOREIGN PATENT DOCUMENTS

| | | | |
|---|---|---|---|
| CH | 693155 | A5 | 3/2003 |
| EP | 0562155 | A1 | 9/1993 |
| EP | 1959317 | A1 | 8/2008 |
| WO | 2007/115984 | A2 | 10/2007 |

OTHER PUBLICATIONS

Search Report in related Swiss appl. No. CH00912/10, dated Nov. 24, 2010 (w/ category A for each reference).

* cited by examiner

*Primary Examiner* — Sean Kayes

(74) *Attorney, Agent, or Firm* — Westerman, Hattori, Daniels & Adrian, LLP

(57) ABSTRACT

Timepiece having a timepiece movement and comprising a time indicator hand which can indicate a first piece of time information when in a first position, and a second piece of time information when in a second position; a first time indication moving part; and a second time indication moving part, in which the timepiece movement includes a first cam (7) which is fixed to the first time indication moving part (9) and which is shaped to shift the time indicator hand to its first position, and a second cam (8) which is fixed to the time indicator hand and which is shaped to shift the time indicator hand to the second position.

20 Claims, 4 Drawing Sheets

TIMEPIECE HAVING A TIME INDICATOR HAND WHICH IS MOVABLE BETWEEN TWO POSITIONS

BACKGROUND ART

The present invention relates to a timepiece including a time indicator hand which is movable between two positions to indicate two different pieces of time information.

Timepieces of this type are known in the prior art.

More specifically, EP 1 959 317 describes a timepiece which has a switch mechanism enabling the time indicator hand, for example the minute hand, to indicate two different pieces of information, such as the current time and the stop watch time, according to its movement, caused by the actuation of a push button, between a position for indicating the current time and a position indicating the stop watch time.

The switch mechanism which is described includes a transmission pinion rotated by a first moving part of the timepiece movement so as to represent a first piece of information to be displayed, and an element having a first split-second core mounted idly on the transmission pinion and rotated by the first moving part or by a second moving part of the movement so as to represent a second piece of information to be displayed.

The switch mechanism also includes a second split-second core fastened to the transmission pinion, a transmission wheel mounted idly on the transmission pinion and having a first and a second hammer biased against the first and second core respectively, a switch wheel mounted rotatably on the periphery of the transmission wheel and having a first and a second cam acting, respectively, on the first and the second hammer so as to separate, alternately, the contact between the first hammer and the first core and the contact between the second hammer and the second core respectively, in order to change the position of the transmission wheel according to the first or second piece of information to be displayed, respectively, an intermediate drive wheel being mounted idly on the transmission pinion and engaging with the switch wheel, the intermediate drive wheel being fastened to a drive wheel which can be rotated in a controlled way by means of a driving mechanism of the transmission mechanism.

The switch mechanism described in EP 1 959 317 is complex because of the use of numerous parts and their arrangement. In particular, it requires a transmission wheel with two hammers and a switch wheel with two cams.

Another switch mechanism for a timepiece enabling the minutes or the date to be indicated by the minute hand is described in CH 693 155.

This mechanism operates with a differential system and a planet gear fixed to a resetting cam, the differential system enabling an angular movement to be imparted to the minute hand to indicate a date. This mechanism is complex, and the planet carrier placed between the moving parts of the differential occupies a certain amount of vertical space.

Consequently there is a need to replace the existing switch mechanisms, and to simplify the timepiece movements, in timepieces in which a single time indicator hand can indicate two different pieces of information.

SUMMARY OF THE INVENTION

The object of the present invention is to overcome the aforementioned drawbacks, at least partially.

For this purpose, the present invention describes a timepiece having a timepiece movement and comprising a time indicator hand which can indicate a first piece of time information when in a first position, and a second piece of time information when in a second position; two concentric fixed scales for displaying the first and the second time indication respectively; and a first time indication moving part and a second time indication moving part, positioned concentrically and connected to the timepiece movement so as to be driven with two different periodicities.

The timepiece movement is distinctive in that it includes a first cam which is fixed to the first time indication moving part and which is shaped to shift the time indicator hand to its first position, a second cam which is coaxial with the first cam, is fixed to the time indicator hand and is rotatable with respect to the first cam, and which is shaped to shift the time indicator hand to the second position, a lever mounted pivotably on the second time indication moving part, actuating means for making the lever engage with the second cam in order to shift the time indication hand to the second position, and resilient return means engaged with the first cam to return the time indicator hand to the first position as soon as the lever ceases to engage with the second cam.

Advantageously, the resilient return means include a rotatable moving part to which the second cam is fastened and which can be rotated with respect to the first cam.

Also advantageously, the resilient return means include a pressure roller which moves on the first cam, and resilient means for returning the pressure roller into the recess of the first cam to position the time indicator hand in the first position, all these means being fastened to a face of the rotatable moving part opposite that to which the second cam is fastened.

Preferably, the rotatable moving part is fixed to a second tube to which the time indicator hand is fastened, and the first cam is fixed to a first tube which is fitted inside the second tube.

The lever has a first end which is substantially rounded and is intended to bear on the second cam, and a second end in the shape of a finger.

The means for actuating the lever include a transmission ring pivoting around the second time indication moving part and having, on its inner perimeter, teeth arranged so as to enable the lever to pivot with respect to the second time indication moving part by interaction between the second end of the lever and a tooth.

BRIEF DESCRIPTION OF THE DRAWINGS

The appended drawing is a schematic illustration of a purely exemplary embodiment of the timepiece proposed by the present invention, which in this case is a wristwatch.

DETAILED DESCRIPTION OF PARTICULAR EMBODIMENTS

Figure 1:
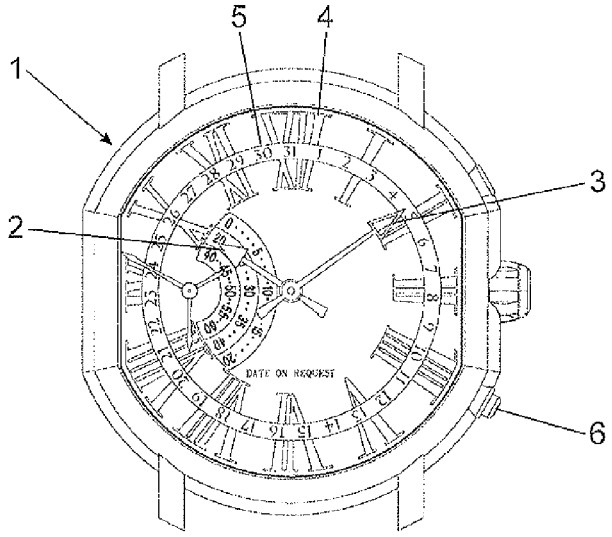
FIGS. 1, 2 and 3 are frontal views of the dial of the wristwatch, showing the display members, particularly the minute hand, and showing, respectively, a first position, a second position reached after the user has pressed a push button, and the first position which is resumed after the push button has been released.
Figure 2:
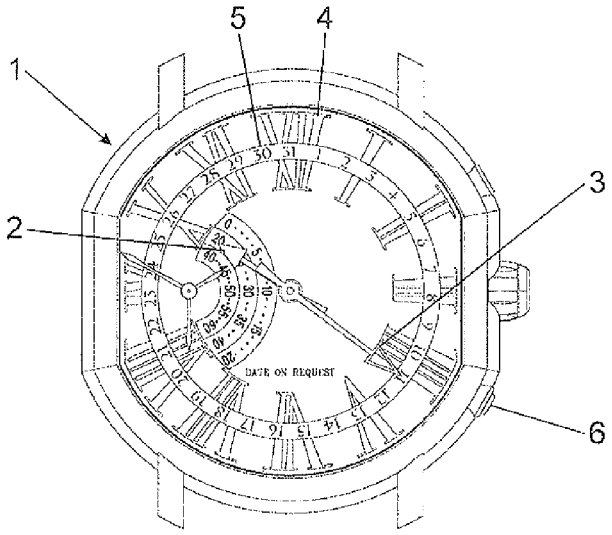
Figure 3:
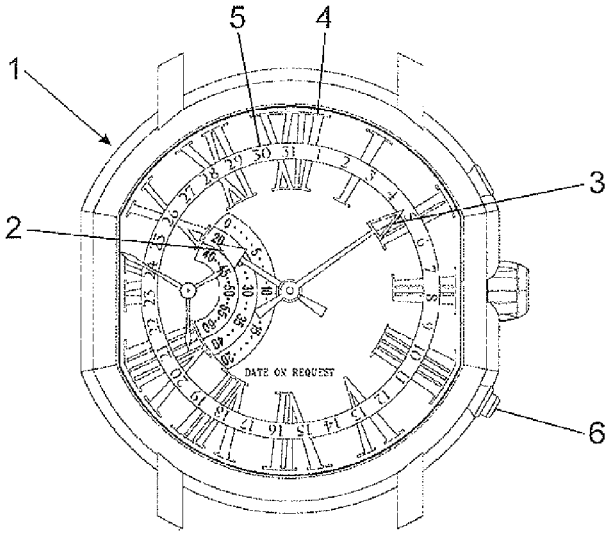

The timepiece described below is, as shown in FIGS. 1 to 3, a wristwatch 1 indicating the time by means of an hour hand 2 and indicating the minutes by means of a minute hand 3, the hands being placed in a first position which is read with respect to a first fixed time indicator scale 4.

Because of the distinctive mechanism of the timepiece movement according to the invention described with the aid of FIGS. 4 to 10, one of the hands, which in the case of the illustrated embodiment is the minute hand 3, is moved to a second position which is read with respect to a second fixed time indicator scale 5, which in this case is a scale showing the date, after pressure on a push button 6 placed at the four o'clock position on the wristwatch 1.

The timepiece movement according to the invention includes a first cam 7, shown in FIGS. 4 to 7, shaped to shift the minute hand 3 to a first position, and a second cam 8, shown in FIGS. 4 to 9, which is fixed to the minute hand 3, coaxial with the first cam 7, rotatable with respect to the first cam 7, and shaped to shift the minute hand 3 to the second position.

Figure 4:
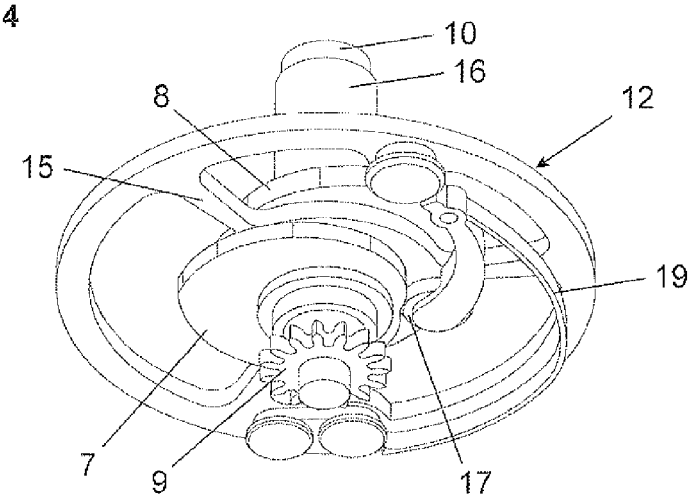
FIGS. 4 and 5 are perspective views from above and below of the rotatable moving part used according to the invention to connect and disconnect a first cam and a second cam.
Figure 5:
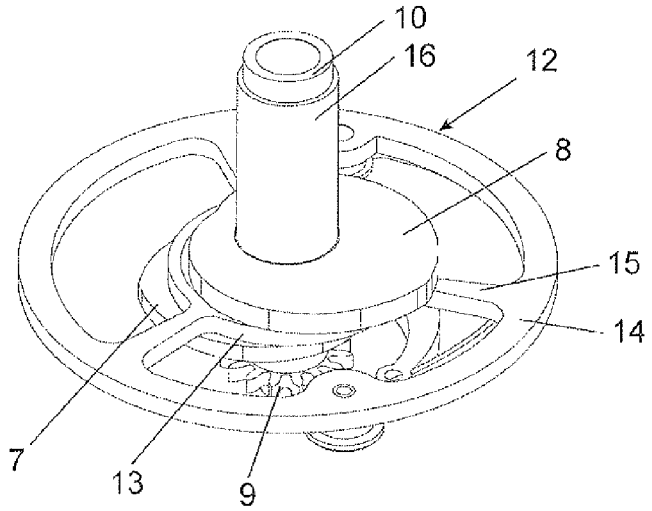
Figure 10:
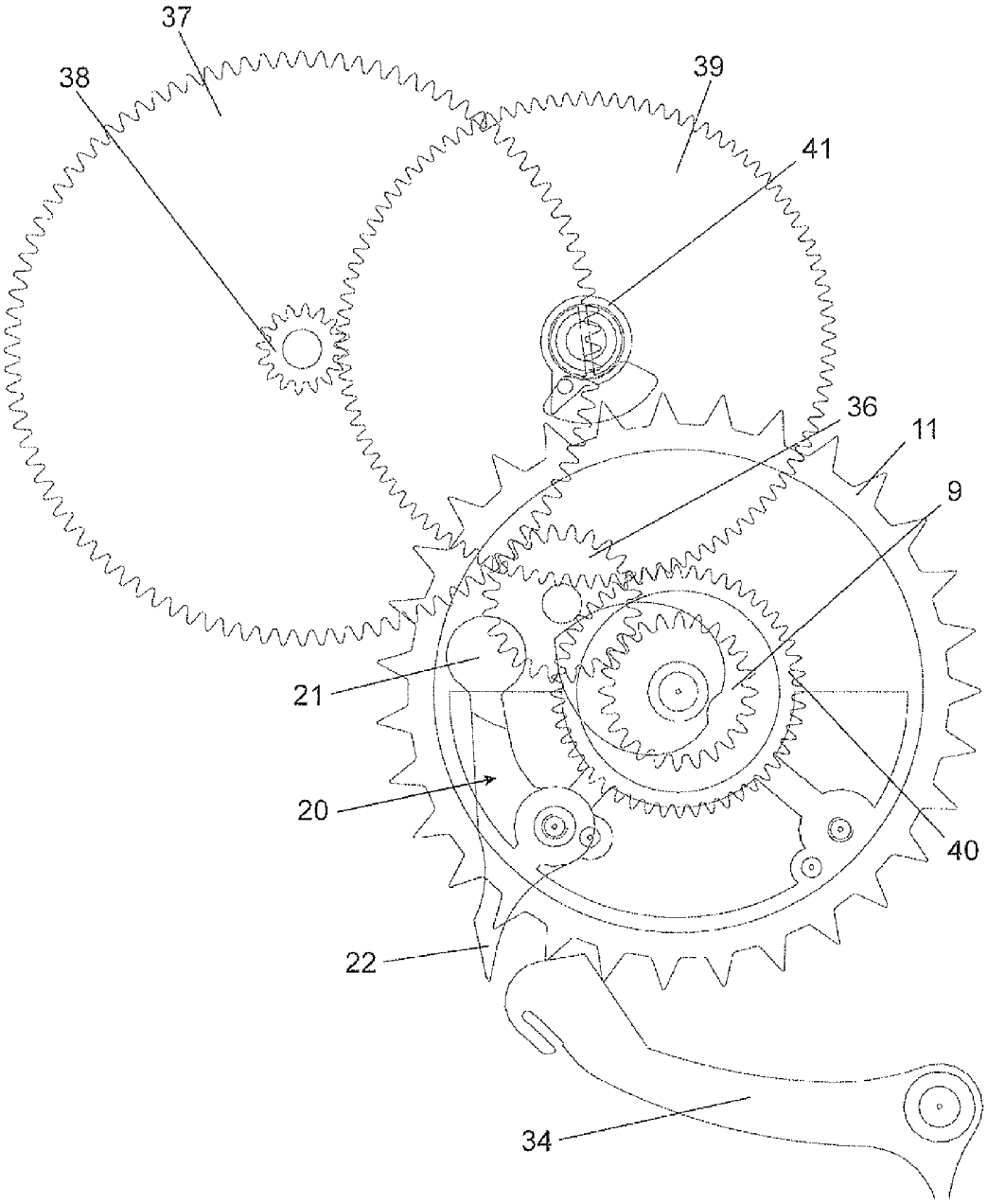
FIG. 10 is a plan view, from the movement side, of the timepiece movement according to the invention.

A first time indication moving part 9, shown in FIGS. 4, 5 and 10, is fixed to the first cam 7 and is, in the illustrated embodiment, the cannon pinion linked to the motion work.

The cannon pinion 9 and the first cam 7 are fixed to a single tube 10 called the "first tube".

Figure 8:
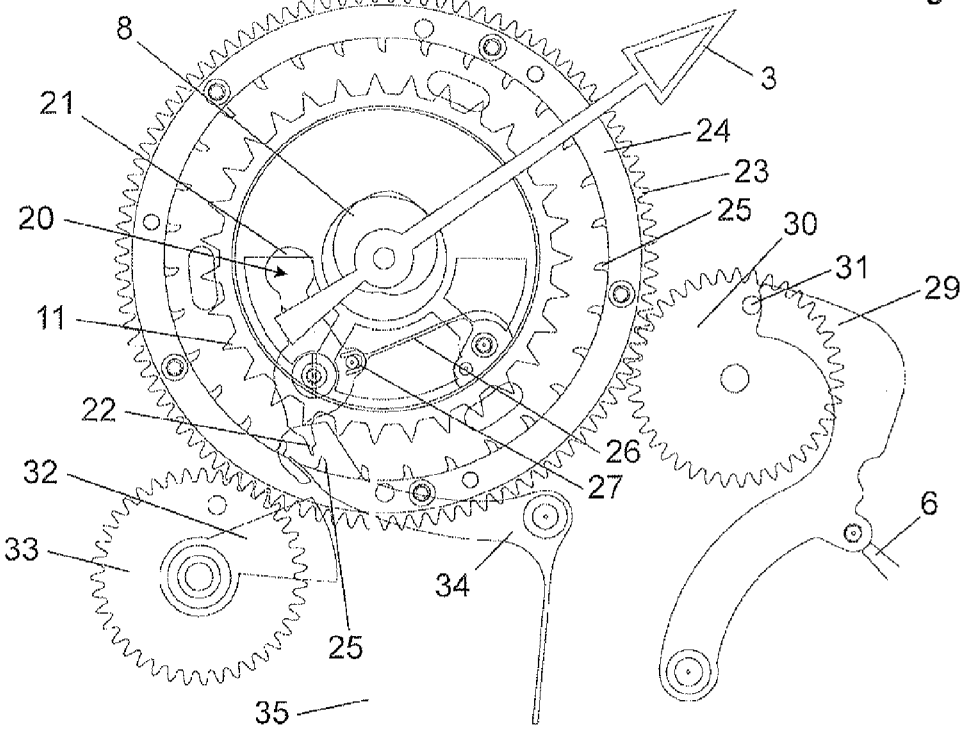
FIG. 8 is a plan view, from the dial side, of the timepiece movement according to the invention, in which the minute hand indicates the first position shown in FIG. 1.
Figure 9:
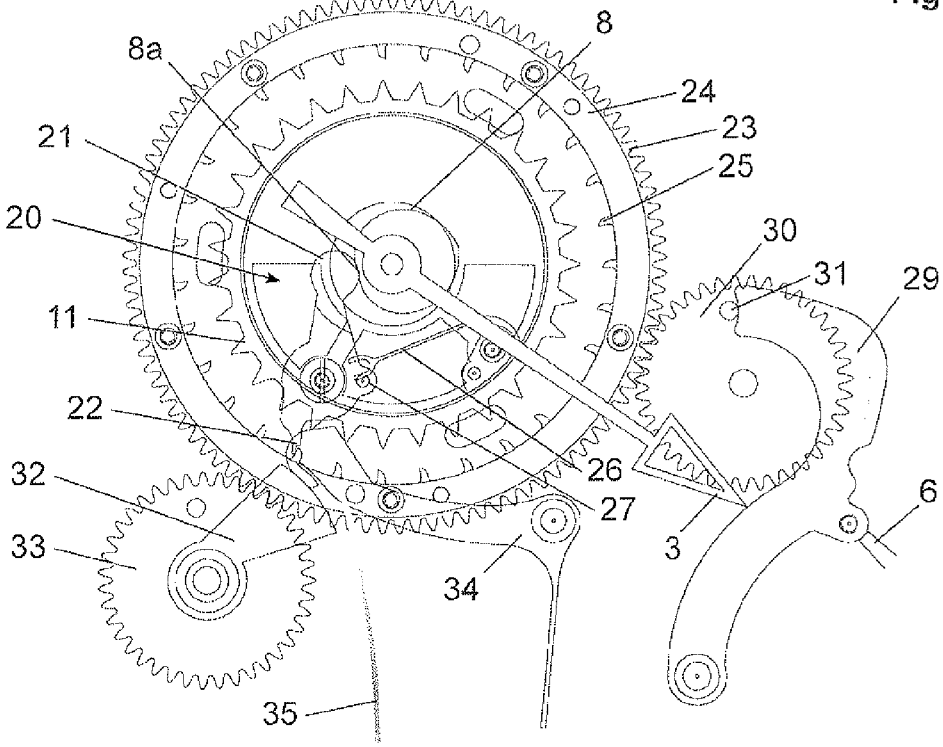
FIG. 9 is a view similar to that of FIG. 8, in which the minute hand indicates the second position shown in FIG. 2.

A second time indication moving part 11, shown in FIGS. 8 to 10, located coaxially and rotatably around the first time indication moving part 9, is freely rotatable with respect to the second cam 8. It is connected to the timepiece movement in such a way that it is driven with a periodicity different from that of the first time indication moving part 9. In the embodiment described here, the second time indication moving part 11 is a date wheel.

A rotatable moving part 12 shown in FIGS. 4 to 7 can be used to connect and disconnect the first cam 7 and the second cam 8. It takes the form of a flywheel having a central part 13 to which the second cam 8 is fastened and a peripheral part 14, such as a ring, connected to the central part 13 by three arms 15.

The rotatable moving part 12 is fixed to a tube 16 called the "second tube" to which the minute hand 3 is fastened and inside which the first tube 10 is fitted. Resilient return means are fastened to the rotatable moving part 12, on a face opposite the face to which the second cam 8 is fastened, and engage with the first cam 7. They include a pressure roller 17, connected to the ring 14 of the moving part 12 by a pivoting arm 18. The pressure roller 17 moves against the first cam 7.

Figure 6:
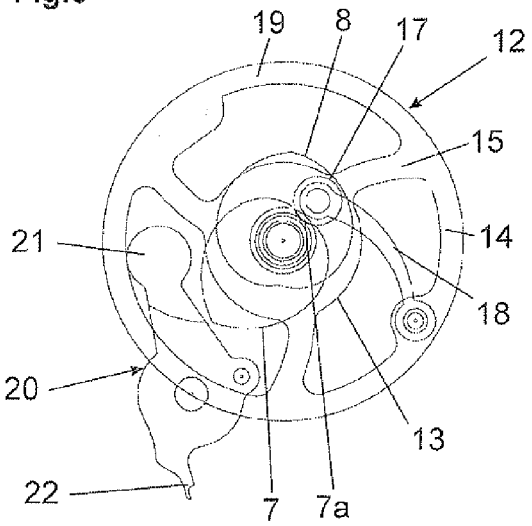
FIGS. 6 and 7 are plan views of the rotatable moving part and the two cams, in the first and second positions.

A return spring 19 located on the ring 14 acts on the pivoting arm 18 and enables the pressure roller 17 to be returned to an equilibrium position corresponding to the positioning of the pressure roller 17 in the recess 7*a* of the first cam 7, as shown in FIG. 6. Thus the rotatable moving part 12 is mounted so as to be rotatable with respect to the first cam 7.

As shown in FIGS. 6 to 10, a drive lever 20 of the second cam 8 is mounted pivotably on the date wheel 11 so as to engage with the second cam 8 in order to shift the minute hand 3 to the second position. Since it is positioned on the date wheel 11, it moves together with the latter with respect to the second cam 8.

It has a first substantially rounded end 21 intended to bear on the second cam 8 in order to move it to the second position, and a second end 22 in the shape of a finger.

As shown in FIGS. 8 and 9, the lever 20 is rotated by the interaction of its second finger-shaped end 22 with actuating means.

The means for actuating the lever 20 include a toothed transmission wheel 23 and a transmission ring 24 positioned coaxially and rotatably around the date wheel 11, the toothed transmission wheel 23 carrying the transmission ring 24.

The inner perimeter of the transmission ring 24 has teeth 25 which interact with the second end 22 of the lever 20, thus enabling the lever 20 to pivot with respect to the date wheel 11.

A return spring 26 acts on a pin 27 located on an intermediate part of the lever 20 in order to keep the lever fixed with respect to the date wheel 11 when the lever 20 is not moved by a tooth 25.

The actuating means also include an L-shaped rocker 29 connected mechanically to a drive wheel 30 by the pressure of the end of the rocker 29 on a pin 31 of the drive wheel. The drive wheel 30 engages with the toothed transmission wheel 23.

A projection 32, coaxial with and fixed to a toothed wheel 33 engaging with the toothed transmission wheel 23, pivots and bears with a curved surface on a jumper spring 34 to hold it between two teeth of the date wheel 11 in order to prevent any unintended movement of the latter in the course of the request for the date.

A return spring 35 enables the transmission ring 24, the toothed transmission wheel 23 and the toothed drive wheel 30 to return, after the release of the push button 6, to the respective positions which they assumed before the push button 6 was pressed.

As shown in FIGS. 8, 9 and 10, the date wheel 11 has 31 uniformly distributed teeth, giving it the shape of a star. It is freely rotatable with respect to the second cam 8, while it is connected mechanically to the pinion 9 and thus to the first cam 7.

As shown in FIG. 10, the date wheel 11 is connected to the pinion 9 by a set of moving parts comprising a return pinion 36 engaging with the pinion 9 and with a first intermediate toothed wheel 37 having at its centre a pinion 38 engaging with a second toothed wheel 39 completing one revolution per day.

The second toothed wheel 39 engages with the hour wheel 40 and has in its centre a drive finger 41 of the date wheel 11. The drive finger 41 causes the date wheel 11 to rotate with respect to the dial, together with the lever 20 fastened to the date wheel 11, through one interval per day, thus enabling a new date to be indicated every day.

The operation of the timepiece mechanism described above is as follows.

Figure 7:
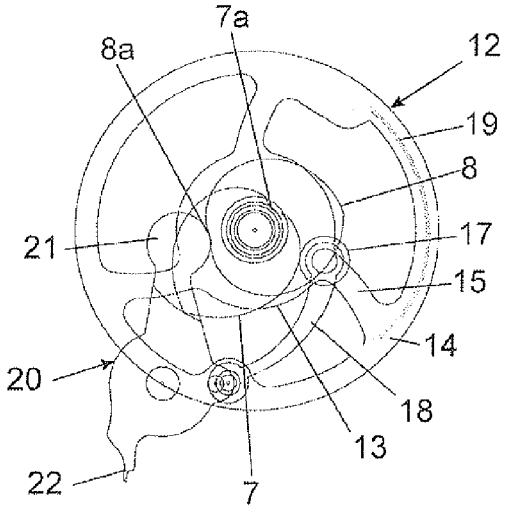

When the user presses the push button 6 to discover the date, the movement of the push button 6 drives the rocker 29 which drives, by means of the pin 31, the drive wheel 30, the transmission wheel 23 and the transmission ring 24 whose teeth 25 drive the lever 20. The drive lever 20 then pivots in the direction of the hands of the watch 1, as a result of the movement of its second end 22 which is driven by the tooth 25, as shown in FIGS. 7 and 9, and its first end 21 comes into contact with the second cam 8 which is fixed to the minute hand 3.

The second cam 8 is then driven by the pivoting of the lever 20. The rotatable moving part 12 fixed to the second cam 8 and to the second tube 16 pivots around the first tube 10. The movement of the rotatable moving part 12 stops as soon as the lever 20 is in the recess 8*a* of the second cam 8, and in this case the minute hand 3 is located in the second position, corresponding to the second time indication.

When the user releases the push button 6, the rotatable moving part 12 and the second cam 8 are returned under the action of the resilient means and the pressure roller 17, thus causing the rotation of the second tube 16 and of the second cam 8 around the first tube 10, until the pressure roller 17 is located in the recess 7*a* of the first cam 7 corresponding to the first position of the minute hand 3.

The lever 20 is then driven in the opposite direction to the hands of the watch 1, by means of its first rounded end 21 which is in contact with the second cam 8. The pin 27 of the lever 20 locks into the fork of the return spring 26.

The transmission wheel 23 and the transmission ring 24 are driven in the opposite direction to the hands of the watch 1 by the return spring 35, causing the movement of the drive wheel 30 and consequently the movement of the rocker 29 by means of the pin 31.

In this case, the second cam 8 and the rotatable moving part 12 are driven together with the first cam 7, and consequently with the pinion 9, by means of the pressure roller 17. The minute hand 3, fixed to the second cam 8 by the second tube 16, follows the movement of the pinion 9 and indicates the first position. In other words, the first tube 10 and the second tube 16 pivot together.

Thus the resilient return means, particularly the rotatable moving part 12 and the pressure roller 17, are connected to the first cam 7 when the push button 6 is released and are disconnected from the first cam 7 when the push button 6 is pressed and the lever 20 is in contact with the second cam 8.

Other arrangements of the rotatable moving part 12, the two cams 7 and 8, the first tube 10 and the second tube 16 are possible, the essential feature being that the second cam 8 can pivot with the first cam 7 without the action of the lever 20 and can pivot independently of the first cam 7 under the action of the lever 20, this lever being mounted on the date wheel 11 and being moved once every day at a given frequency with respect to the dial of the timepiece.

The present invention can be applied to any time indication, for example a power reserve indicator, as an alternative to the date indication, and can be applied to any time indicator hand, for example the hour hand 2, as an alternative to the minute hand 3.

In a variant, it would be possible to connect the date wheel 11 to a perpetual date mechanism.

The invention claimed is:

1. Timepiece having a timepiece movement and comprising a time indicator hand which can indicate a first time indication when in a first position, and a second time indication when in a second position; two concentric fixed scales for displaying the first and the second time indication respectively; and a first time indication moving part and a second time indication moving part, positioned concentrically and connected to the timepiece movement so as to be driven with two different periodicities, wherein the timepiece movement includes a first cam which is fixed to the first time indication moving part and which is shaped to shift the time indicator hand to the first position, a second cam which is coaxial with the first cam is fixed to the time indicator hand and is rotatable with respect to the first cam, and which is shaped to shift the time indicator hand to the second position, a lever mounted pivotably on the second time indication moving part, actuating means for making the lever engage with the second cam in order to shift the time indication hand to the second position, and resilient return means engaged with the first cam to return the time indicator hand to the first position as soon as the lever ceases to engage with the second cam.

2. Timepiece according to claim 1, wherein the timepiece is a wristwatch.

3. Timepiece according to claim 1, wherein the time indicator hand is the minute hand, the first position indicates the minutes, the second position indicates the date, the first time indication moving part is the pinion, and the second time indication moving part is the star-shaped date wheel comprising 31 teeth.

4. Timepiece according to claim 3, wherein the timepiece movement includes a toothed wheel completing one revolution per day, and having, in a center of the toothed wheel, a driving finger of the second time indication moving part, the driving finger causing the second time indication moving part to pivot through one interval every day.

5. Timepiece according to claim 1, wherein the actuating means include a rocker, a toothed transmission wheel to which the transmission ring is fastened, and a toothed drive wheel which is made to rotate by the rocker and which engages with the toothed transmission wheel.

6. Timepiece according to claim 5, wherein a toothed wheel engages with the toothed transmission wheel and includes a projection which is arranged so as to lock a jumper spring against the second time indication moving part.

7. Timepiece according to claim 1, wherein the lever has a first substantially rounded end intended to bear on the second cam, and a second end in the shape of a finger, and the means for actuating the lever include a transmission ring pivoting around the second time indication moving part and having, on an inner perimeter of the transmission ring, teeth arranged so as to enable the lever to pivot with respect to the second time indication moving part by interaction between the second end of the lever and a tooth.

8. Timepiece according to claim 7, wherein the actuating means include a rocker, a toothed transmission wheel to which the transmission ring is fastened, and a toothed drive wheel which is made to rotate by the rocker and which engages with the toothed transmission wheel.

9. Timepiece according to claim 1, wherein the resilient return means include a rotatable moving part to which the second cam is fastened and which is rotatable with respect to the first cam.

10. Timepiece according to claim 9, wherein the time indicator hand is the minute hand, the first position indicates the minutes, the second position indicates the date, the first time indication moving part is the pinion, and the second time indication moving part is the star-shaped date wheel comprising 31 teeth.

11. Timepiece according to claim 10, wherein the timepiece movement includes a toothed wheel completing one revolution per day, and having, in a center of the toothed wheel, a driving finger of the second time indication moving part, the driving finger causing the second time indication moving part to pivot through one interval every day.

12. Timepiece according to claim 9, wherein the actuating means include a rocker, a toothed transmission wheel to which the transmission ring is fastened, and a toothed drive wheel which is made to rotate by the rocker and which engages with the toothed transmission wheel.

13. Timepiece according to claim 9, wherein the rotatable moving part is fixed to a second tube to which the time indicator hand is fastened and the first cam is fixed to a first tube fitted inside the second tube.

14. Timepiece according to claim 13, wherein the lever has a first substantially rounded end intended to bear on the second cam, and a second end in the shape of a finger, and the means for actuating the lever include a transmission ring pivoting around the second time indication moving part and having, on an inner perimeter of the transmission ring, teeth arranged so as to enable the lever to pivot with respect to the second time indication moving part by interaction between the second end of the lever and a tooth.

15. Timepiece according to claim 13, wherein the actuating means include a rocker, a toothed transmission wheel to which the transmission ring is fastened, and a toothed drive wheel which is made to rotate by the rocker and which engages with the toothed transmission wheel.

16. Timepiece according to claim 9, wherein the resilient return means include a pressure roller which moves on the first cam, and resilient means for returning the pressure roller into the recess of the first cam to position the time indicator hand in the first position, all these means being fixed on a face of the rotatable moving part opposite that to which the second cam is fastened.

17. Timepiece according to claim 16, wherein the rotatable moving part is fixed to a second tube to which the time indicator hand is fastened and the first cam is fixed to a first tube fitted inside the second tube.

18. Timepiece according to claim 16, wherein the lever has a first substantially rounded end intended to bear on the second cam, and a second end in the shape of a finger, and the means for actuating the lever include a transmission ring pivoting around the second time indication moving part and having, on an inner perimeter of the transmission ring, teeth arranged so as to enable the lever to pivot with respect to the second time indication moving part by interaction between the second end of the lever and a tooth.

19. Timepiece according to claim 16, wherein the actuating means include a rocker, a toothed transmission wheel to which the transmission ring is fastened, and a toothed drive wheel which is made to rotate by the rocker and which engages with the toothed transmission wheel.

20. Timepiece according to claim 9, wherein the lever has a first substantially rounded end intended to bear on the second cam, and a second end in the shape of a finger, and the means for actuating the lever include a transmission ring pivoting around the second time indication moving part and having, on an inner perimeter of the transmission ring, teeth arranged so as to enable the lever to pivot with respect to the second time indication moving part by interaction between the second end of the lever and a tooth.

* * * * *